US009022536B2

(12) United States Patent
Ichihara et al.

(10) Patent No.: US 9,022,536 B2
(45) Date of Patent: May 5, 2015

(54) LIQUID SUPPLY DEVICE AND LIQUID EJECTING APPARATUS

(71) Applicant: Seiko Epson Corporation, Tokyo (JP)

(72) Inventors: Keita Ichihara, Matsumoto (JP); Keitaro Nakano, Matsumoto (JP); Atsushi Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/106,453

(22) Filed: Dec. 13, 2013

(65) Prior Publication Data

US 2014/0168295 A1 Jun. 19, 2014

(30) Foreign Application Priority Data

Dec. 18, 2012 (JP) ..... 2012-275397

(51) Int. Cl.
*B41J 2/175* (2006.01)
*B41J 2/165* (2006.01)
*B41J 2/18* (2006.01)

(52) U.S. Cl.
CPC ..... *B41J 2/175* (2013.01); *B41J 2/16523* (2013.01); *B41J 2/17509* (2013.01); *B41J 2/18* (2013.01)

(58) Field of Classification Search
CPC ..... B41J 2/175
USPC ..... 347/6, 7, 85–89
See application file for complete search history.

(56) References Cited

U.S. PATENT DOCUMENTS 6,428,156 B1 * 8/2002 Waller et al. ..... 347/89
7,140,724 B2 * 11/2006 Otis et al. ..... 347/89
2003/0048340 A1 3/2003 Kubota

FOREIGN PATENT DOCUMENTS

JP 03-027951 2/1991
JP 2001-030513 2/2001
JP 2008-055646 3/2008
JP 2011-098537 5/2011

* cited by examiner

*Primary Examiner* — Julian Huffman
(74) *Attorney, Agent, or Firm* — Workman Nydegger

(57) ABSTRACT

Provided is a liquid supply device that includes a liquid storage portion that stores liquid containing sedimenting components which are sedimented in solvent, a liquid supply path that extends from the liquid storage portion to a liquid ejecting portion and through which the liquid to be supplied to the liquid ejecting portion can flow, a liquid flowing portion that is operated to cause the liquid to flow through at least part of the liquid supply path, a temperature detection portion that can detect the temperature of at least part of the liquid in the liquid supply path, and an operation control portion that controls an operation of the liquid flowing portion in correspondence with a detected temperature of the liquid, which is detected by the temperature detection portion, such that a flow condition of the liquid in the liquid supply path changes.

20 Claims, 6 Drawing Sheets

LIQUID SUPPLY DEVICE AND LIQUID EJECTING APPARATUS

BACKGROUND

1. Technical Field

The present invention relates to a liquid supply device for supplying liquid to a liquid ejecting portion, and a liquid ejecting apparatus equipped with the liquid supply device.

2. Related Art

As an example of a liquid ejecting apparatus that ejects liquid onto a medium, an ink jet type printer has been widely known. This printer carries out printing by causing ejecting nozzles, which are formed on a liquid ejecting head (a liquid ejecting portion), to eject ink (liquid), which is supplied from an ink cartridge (a liquid storage portion), onto a medium (a paper sheet, for example). In recent years, pigment ink, ultraviolet-ray curable ink (UV ink), or the like has been used in such a printer.

This type of ink contains sedimenting components (pigment particles, for example) that are higher in specific gravity than solvent of the ink and sedimented in the solvent. Therefore, the sedimenting components are sedimented in the solvent with the elapse of time, and thus the density of the sedimenting components becomes irregular. As a result, there is a problem in that hue of the ink changes. Particularly, it is easy for the sedimenting components to be sedimented in a liquid supply path that is an ink flow path extending from the ink cartridge to the liquid ejecting head. Therefore, if the irregularity in the density of the pigment particles, which is caused by the sedimentation, is not suppressed in the liquid supply path, it is difficult to suppress the change of the hue of the ink supplied to the liquid ejecting head, even when the ink of which pigment particles are agitated is supplied from the ink cartridge through the liquid supply path, for example.

Accordingly, a technique that is capable of suppressing a change of hue of ink supplied to a liquid ejecting head has been proposed in JP-A-2011-98537, for example. In this technique, time measurement starts after the liquid ejecting head discharges ink supplied from a liquid supply path (a liquid passage), and further, a low flow velocity time, namely the time in which the ink flow velocity in the liquid supply path does not attain the predetermined flow velocity, is obtained. Then, the ink is discharged from the liquid ejecting head, by referring to the obtained low flow velocity time, to allow the ink in the liquid supply path to flow.

Meanwhile, regarding ink, such as pigment ink or UV ink, the viscosity coefficient of solvent thereof varies with a temperature change. Thus, in the case of ink of which the viscosity at low temperature is higher than that at high temperature, if the temperature of the ink lowers, the sedimentation velocity of sedimenting components in the solvent is reduced. Thus, if the discharging ink through the liquid ejecting head is carried out only based on a time measurement result of the low flow velocity time, it can cause the following problem. When the temperature of the ink lowers, for example, there is a possibility that the ink is discharged outside the liquid supply path even when the sedimenting components are not too much sedimented. As a result, an ink flowing operation is performed more than necessary in the liquid supply path, and thus, the ink can be wasted unnecessarily or energy (electric power, for example) can be wasted unnecessarily for the flowing operation.

Such a situation is usually common in a liquid supply device that includes a liquid storage portion for storing, not limited to ink, liquid containing sedimenting components and a liquid supply path which extends from the liquid storage portion to a liquid ejecting portion and through which the liquid to be supplied to the liquid ejecting portion can flow, and a liquid ejecting apparatus equipped with this liquid supply device.

SUMMARY

An advantage of some aspects of the invention is to provide a liquid supply device that is capable of suppressing an unnecessary liquid flowing operation in a liquid supply path through which the liquid is supplied to a liquid ejecting portion, and a liquid ejecting apparatus equipped with the liquid supply device.

The following means and operation effects thereof will be described.

According to an aspect of the invention, there is provided a liquid supply device that supplies liquid to a liquid ejecting portion which ejects the liquid. The liquid supply device includes a liquid storage portion that stores the liquid containing sedimenting components which are sedimented in solvent, a liquid supply path that extends from the liquid storage portion to the liquid ejecting portion and through which the liquid to be supplied to the liquid ejecting portion can flow, a liquid flowing portion that is operated to cause the liquid to flow through at least part of the liquid supply path, a temperature detection portion that can detect the temperature of at least part of the liquid in the liquid supply path, and an operation control portion that controls an operation of the liquid flowing portion in correspondence with a detected temperature of the liquid, which is detected by the temperature detection portion, such that a flow condition of the liquid in the liquid supply path changes.

According to this configuration, it is possible to change a flow condition at the time of circulating the liquid through the liquid supply path or discharging the liquid outside the liquid supply path, in correspondence with a sedimentation condition of sedimenting components which varies with a temperature change, for example, in which a sedimentation velocity of the sedimenting components in the solvent is reduced if the temperature of liquid lowers. Therefore, it is possible to suppress an unnecessary liquid flowing operation of the liquid flowing portion.

In the liquid supply device described above, it is preferable that the operation control portion control an operation time of the liquid flowing portion to be extended or shortened in correspondence with a detected temperature, which is detected by the temperature detection portion, thereby a flow condition of the liquid changes.

According to this configuration, it is possible to change a liquid flowing time in the liquid supply path, in correspondence with the sedimentation condition of the sedimenting components, which varies with a temperature change of the liquid, for example, in which an operation time of the liquid flowing portion is shortened as the temperature of liquid lowers. Therefore, it is possible to suppress an unnecessary liquid flowing operation of the liquid flowing portion.

In the liquid supply device described above, it is preferable that the operation control portion control a liquid flow velocity in the liquid supply path to be increased or reduced in correspondence with a detected temperature, which is detected by the temperature detection portion, thereby a flow condition of the liquid changes.

According to this configuration, it is possible to change a liquid flow velocity in the liquid supply path, in correspondence with the sedimentation condition of the sedimenting components, which varies with a temperature change of the liquid, for example, in which a liquid flow velocity in the liquid supply path decreases as the temperature of the liquid lowers. Therefore, it is possible to suppress an unnecessary liquid flowing operation of the liquid flowing portion.

It is preferable that the liquid supply device described above further include a time measurement portion that measures the elapsed time after an operation of the liquid flowing portion, in which the operation control portion causes the liquid flowing portion to operate when the elapsed time measured by the time measurement portion attains to a predetermined set time, which is set in correspondence with a detected temperature detected by the temperature detection portion, thereby a flow condition of the liquid changes.

According to this configuration, it is possible to change a flow frequency of the liquid in the liquid supply path, in correspondence with the sedimentation condition of the sedimenting components, which varies with a temperature change of the liquid, for example, in which a set time increases as the temperature of the liquid lowers so that the operation intervals of the liquid flowing portion increases. Therefore, it is possible to suppress an unnecessary liquid flowing operation of the liquid flowing portion.

In the liquid supply device described above, it is preferable that the temperature detection portion detect an average value of the temperatures of the liquid, which are detected at predetermined time intervals, as a detected temperature of the liquid.

According to this configuration, when the temperature of the liquid in the liquid supply path varies owing to a seasonal temperature difference, a temperature difference between the morning and the daytime, or the like, for example, it is possible to adequately circulate the liquid or discharge the liquid outside the liquid supply path, in correspondence with the sedimentation condition of the sedimenting components, which varies with the temperature change. Therefore, it is possible to suppress an unnecessary liquid flowing operation of the liquid flowing portion.

In the liquid supply device described above, it is preferable that the operation control portion control an operation of the liquid flowing portion when the detected temperature is within the range of between 20 degrees Celsius and 30 degrees Celsius.

For use of the liquid ejecting portion that forms an image or the like by ejecting liquid onto a paper sheet or the like, an ambient temperature of the liquid supply device is usually set within the temperature range of between 20° C. to 30° C., in which the liquid can be stably ejected by the liquid ejecting portion. Thus, according to this configuration, in this temperature range, the operation of the liquid flowing portion is controlled in correspondence with a detected temperature. Therefore, it is possible to effectively suppress an unnecessary liquid flowing operation of the liquid flowing portion.

The liquid ejecting apparatus includes the liquid ejecting portion that ejects liquid and the liquid supply device with the configuration described above.

According to this configuration, in the liquid supply path, it is possible to adequately circulate liquid or to discharge liquid outside the liquid supply path, in correspondence with the sedimentation condition of the sedimenting components. Thus, it is possible to achieve the liquid ejecting apparatus that is capable of suppressing an unnecessary liquid flowing operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet type printer (also referred to as a "printer"), as an example of a liquid ejecting apparatus equipped with a liquid supply device, will be described with reference to accompanying drawings. The printer of the embodiment forms an image or the like, such as a character or a figure, by causing a liquid ejecting portion to eject liquid, which is supplied from a liquid supply portion to the liquid ejecting portion through a liquid supply path, onto a medium which is transported in one direction.

Figure 1:
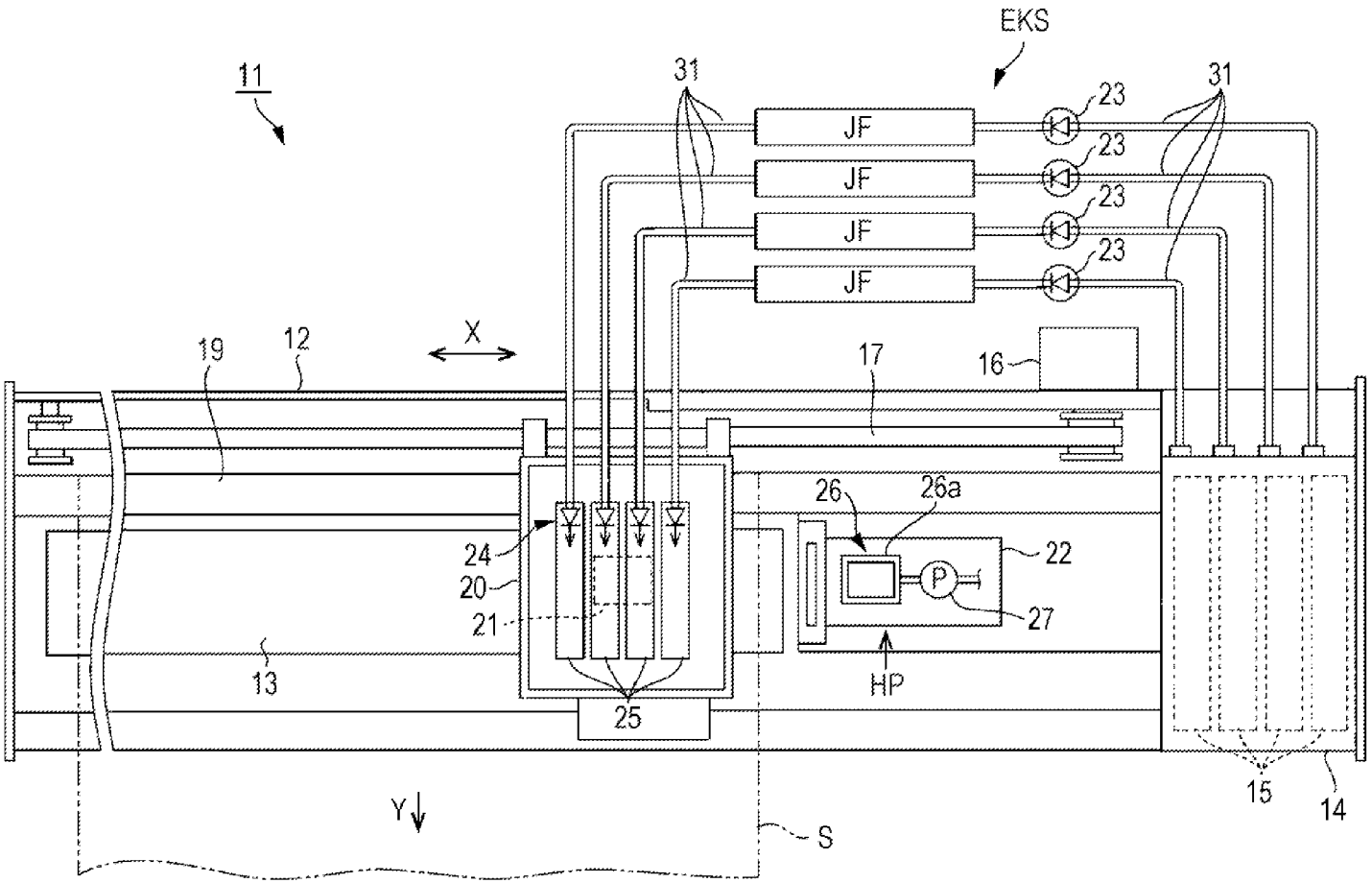
FIG. 1 is a schematic configuration view of a printer, as an example of a liquid ejecting apparatus.

In a printer 11 of the embodiment, as an example of a liquid ejecting apparatus, a support member 13 extends in a lower portion, namely a gravity direction side, of a substantially rectangular box-shaped frame 12, as shown in FIG. 1. The support member 13 supports a paper sheet S, as an example of a medium, in a longitudinal direction X when image forming, namely printing, is carried out. In addition, a paper feeding mechanism (not shown) is driven by driving of a paper feeding motor (not shown) that is provided in a lower portion of a rear side, namely a side in an opposite direction to a transport direction Y of the paper sheet S, of the frame 12. The paper sheet S is transported by the paper feeding mechanism and moves over the support member 13 in the transport direction Y. In this case, the transport direction Y is specified as a short-length direction (a front direction) perpendicular to the longitudinal direction X of the support member 13.

Furthermore, a plurality (four in this case) of ink cartridges 15, as an example of an liquid storage portion for storing ink, as an example of liquid, are detachably mounted on a cartridge holder 14 that is installed on one end side (a right end side when viewed from a front side in the transport direction Y, in the embodiment) of the frame 12 in the longitudinal direction X. In addition, in the embodiment, each of the ink cartridges 15 stores different-colored ink and is mounted on the cartridge holder 14. Furthermore, the ink cartridge 15 stores pigment ink which contains pigment particles, as an example of sedimenting components which are likely to be sedimented in solvent. Alternatively, the ink cartridge 15 may store UV ink.

A guide shaft 19 is installed in the frame 12 to extend in the longitudinal direction X, and a carriage 20 is slidably supported by the guide shaft 19. The carriage 20 is fixed to part of an endless timing belt 17 that is rotationally driven by a carriage motor 16 which is provided on an upstream side (a rear side) of the frame 12 in the transport direction Y. Thus, when the timing belt 17 is driven by driving the carriage motor 16, the carriage 20 reciprocates along the guide shaft 19 in the longitudinal direction X, as a scanning direction. Further, in the carriage 20, a liquid ejecting head 21, as an example of a liquid ejecting portion, and a plurality of valve units 25 that are provided in correspondence with respective ink cartridges 15 and that control supplying ink to the liquid ejecting head 21 are mounted. In this case, a plurality of nozzles 21*a* (see FIG. 2) are provided on a lower surface side of the liquid ejecting head 21 to eject ink.

In the frame 12, one end side (a cartridge holder 14 side, in the embodiment) in a moving range of the carriage 20, which extends in the scanning direction, is a non-medium ejection range which is out of a medium ejection range. A home position HP is located in the non-medium ejection range. In addition, a maintenance device 22 is provided at the home position HP to perform various maintenance processes of the liquid ejecting head 21.

The maintenance device 22 includes an ink suctioning mechanism 26. The ink suctioning mechanism 26 causes a cap 26*a* to be lifted up from lower side so that the cap 26*a* abuts on the liquid ejecting head 21 that is moved to the home position HP. Then, the ink suctioning mechanism 26 drives a suction pump 27 so that a sealed space, which is formed by the abutment described above, becomes under a negative pressure condition. In this manner, the ink suctioning mechanism 26 suctions ink through the nozzles 21*a*. The maintenance device 22 of this ink suctioning mechanism 26 carries out the maintenance operation, such as discharging thickening ink from the nozzles 21*a*, in order to stabilize an ink ejecting operation of the nozzles 21*a*. Incidentally, the discharged ink is stored in a waste liquid tank (not shown).

Ink supply tubes 31, as an example of a liquid supply portion, are provided in the printer 11. One end of the ink supply tubes 31 are respectively connected to the ink cartridges 15, and the other ends thereof are connected to the liquid ejecting head 21 via the valve units 25. In the printer 11, these ink supply tubes 31 function as a liquid supply path. Ink supply devices EKS, as an example of a liquid supply device, are provided in the printer 11. Each ink supply device EKS supplies the ink from each ink cartridge 15, namely an upstream side, via each ink supply tube 31 to the liquid ejecting head 21, namely a downstream side.

Furthermore, the valve unit 25 is provided with a pressure control valve 24 functioning as a so-called self sealing valve. When the pressure of the ink is decreased owing to ejection of the ink through the nozzles 21*a*, the pressure control valve 24 is opened, and therefore supplies the ink from the upstream side to the liquid ejecting head (the nozzles 21*a*). The ink supply tube 31 is connected to the upstream side of this pressure control valve 24.

In addition, in the ink supply tube 31, a check valve 23 equipped with an on-off valve 23*a* (see FIG. 2) is provided on a further upstream side than the pressure control valve 24. When the ink flows from the ink cartridge 15 side, namely an upstream side, to the pressure control valve 24 side, namely a downstream side, the check valve 23 opens the on-off valve 23*a*. On the other hand, when the ink flows from the pressure control valve 24 side, namely a downstream side, to the ink cartridge 15 side, namely an upstream side (see void arrow Fp in FIG. 2), the check valve 23 closes the on-off valve 23*a* to prevent the ink flow.

Meanwhile, FIG. 1 illustrates a circulation flow path JF as a block. The circulation flow path JF is formed in the ink supply tube 31 to be disposed between the pressure control valve 24 and the check valve 23. Both ends of the circulation flow path JF are connected to the ink supply tube 31, and therefore, the circulation flow path JF allows ink to circulate through the circulation flow path JF and the ink supply tube 31.

Figure 2:
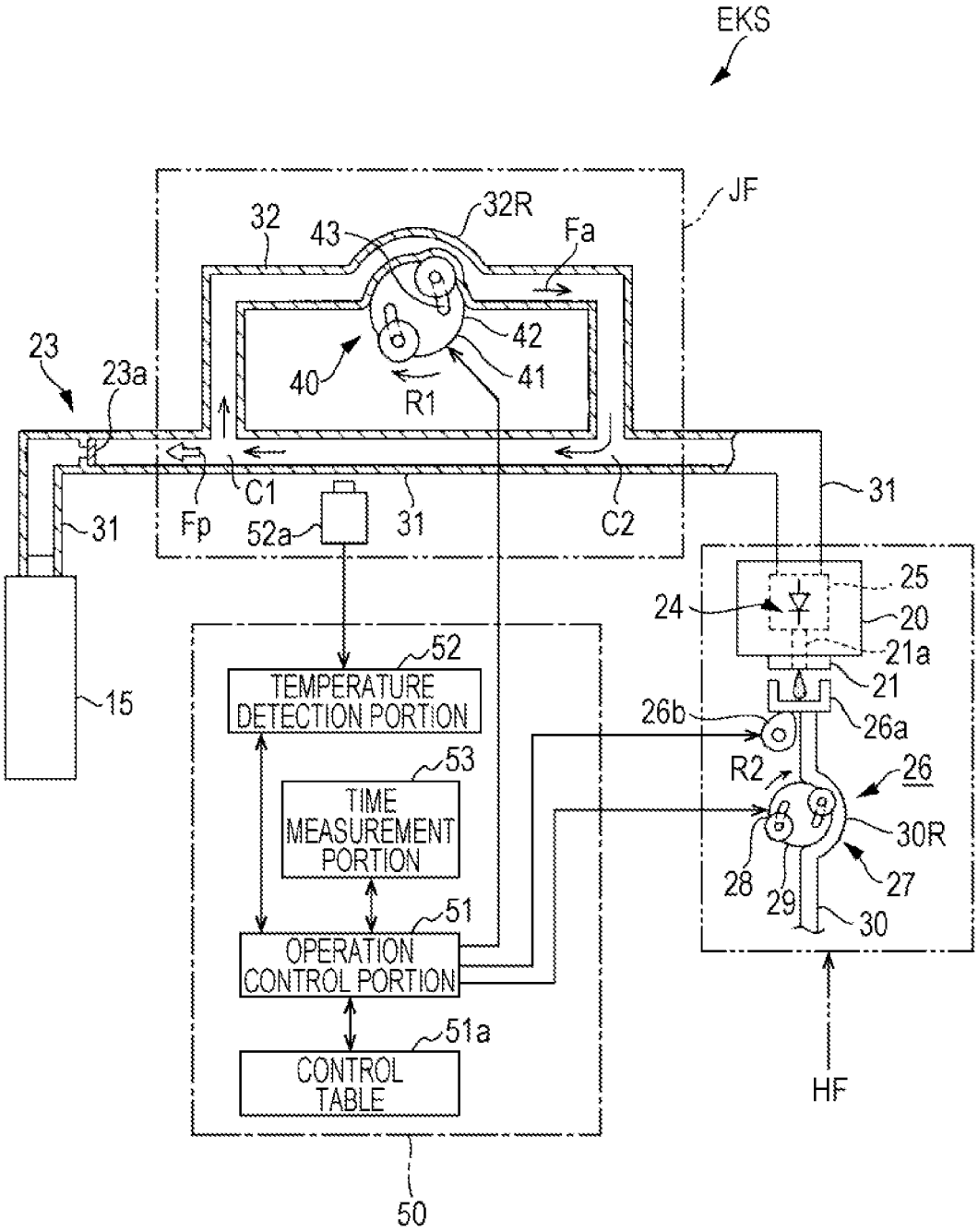
FIG. 2 is a schematic view showing a configuration of an ink supply device of an embodiment, which is provided in the printer.

Next, a configuration of the ink supply device EKS that supplies ink from the ink cartridge 15 to the liquid ejecting head 21 will be described, with the description of the circulation flow path JF, with reference to FIG. 2. In the embodiment, all the circulation flow paths JF have the same configuration. Thus, for simplifying the description, components of the ink supply device EKS that includes one circulation flow path JF are schematically illustrated in FIG. 2. In addition, FIG. 2 illustrates the ink supply tube 31 and the circulation flow path JF as a single continuous member, but, practically, the ink supply tube 31 and the circulation flow path JF are constituted by a plurality of members connected to each other.

As shown in FIG. 2, the ink supply device EKS is provided with an ink circulation tube 32 of which both ends are connected to the ink supply tube 31 via connect portions C1 and C2, and therefore, the circulation flow path JF is formed. The circulation flow path JF allows ink to circulate through the ink circulation tube 32 and the ink supply tube 31. Furthermore, a tube pump that carries out a pump operation to flow ink through the circulation flow path JF is provided, in the ink circulation tube 32, as a circulation pump 40 that is an example of a liquid flowing portion.

The circulation pump 40 operates as follows. In a curved portion 32R which is a flexible tube portion (a part of the ink circulation tube 32, in this case) having an arc shape, when a rotator 41 rotates in one direction by receiving a driving force, a roller 42 that is movably provided on the rotator 41 pushes the ink in a rotation direction. By this pushing movement, the ink flows, in one direction, through the circulation flow path JF. In other words, when the roller 42 comes into contact with the curved portion 32R, the roller 42 moves along a guide hole 43 to move away from the rotation center of the rotator 41. In this manner, the roller 42 squeezes the ink circulation tube 32. By this squeezing movement, the ink in the ink circulation tube 32 is in a pressurized state. Subsequently, the roller 42 squeezes the ink circulation tube 32 and rotates (revolves) along with the rotator 41, and therefore the ink in the ink circulation tube 32 is pressurized and pushed in the rotation direction of the roller 42. Therefore, the ink flows, in one direction, through the circulation flow path JF.

Meanwhile, when the printer 11 carries out an image printing operation, an amount of the ink flowing through the ink supply tube 31 is equal to an amount of the ink consumed by printing. Thus, a flow velocity is slow, and thus, the pigment particles (the sedimenting components), as solutes of the ink, are easily sedimented in the ink supply tube 31. As a result, sediment can be deposited owing to accumulation of the sedimented pigment particles.

Here, the ink supply device EKS carries out an ink flowing operation, in which the circulation pump 40 is rotationally driven to circulate the ink through the circulation flow path JF. In this manner, the ink supply device EKS carries out an agitating operation for dispersing the sediment in the solvent of the ink. Thus, the circulation pump 40 functions as a liquid flowing portion which circulates ink through the circulation flow path JF to flow through the ink supply tube 31. Furthermore, in the embodiment, the circulation pump 40 (the rotator 41) is driven rotationally in a direction indicated by arrow R1 in FIG. 2, during this ink flowing operation, to cause the ink to flow in a direction opposite to a flow direction of the ink when being supplied to the liquid ejecting head 21 in the ink supply tube 31, as indicated by solid arrow Fa in FIG. 2.

Furthermore, in the ink supply device EKS of the embodiment, the sediment can remain without being dispersed, because an agitating flow of the ink which is caused by the circulation flow in the circulation flow path JF is less likely to be generated in the ink supply tube 31 in a further downstream side than the connection portion C2 with respect to the circulation flow path JF. For this reason, in the ink supply device EKS of the embodiment, a discharge operation is carried out to discharge, with the ink, the sediment in a downstream side of the ink supply tube 31.

In other words, the ink suctioning mechanism 26 that is provided in the maintenance device 22 which is disposed in the home position HP in the frame 12 suctions the ink in the downstream side of the ink supply tube 31, via the nozzles 21*a* and the valve unit 25. Specifically, in the ink suctioning mechanism 26, the lifting mechanism 26*b* causes the cap 26*a* to be lifted up from the lower side so that the cap 26*a* abuts on the liquid ejecting head 21 that is moved to the home position HP. Then, the ink suctioning mechanism 26 drives the suction pump 27 so that the sealed space, which is formed by the abutment described above, becomes under a negative pressure condition. In this manner, the ink suctioning mechanism 26 suctions the ink in the ink supply tube 31 through the nozzles 21*a*.

In the embodiment, a tube pump is adopted as the suction pump 27. That is, in a curved portion 30R which is a part of a flexible liquid wasting tube 30 which is formed in an arc shape and connected to the cap 26*a*, when a rotator 28 is driven rotationally by receiving a driving force, a roller 29 that is movably provided on the rotator 28 pushes the fluid (air or ink) in the liquid wasting tube 30 in a rotation direction. In the embodiment, the rotator 28 is driven rotationally in a direction indicated by arrow R2 in FIG. 2.

By this pushing movement of the roller 29, the sealed space, which is formed by lifting up the cap 26*a* from a lower side to abut on the liquid ejecting head, becomes under a negative pressure condition. Therefore, the ink in the ink supply tube 31 flows, via the cap 26*a*, through the liquid wasting tube 30 and is discharged. Thus, a flow path which continues from the ink supply tube 31 via the cap 26*a* to the liquid wasting tube 30 forms an ink discharge flow path HF. In addition, the suction pump 27 functions as a liquid flowing portion which causes the ink in the ink supply tube 31 to be discharged through the discharge flow path HF.

A circulation operation or an ink discharging operation which is carried out by the ink supply device EKS is controlled by a control device 50 that constitutes the ink supply device EKS. Next, a configuration of the control device 50 will be described.

The control device 50 is constituted by an electronic component, such as a semiconductor, on a circuit board that is provided in the printer 11. The control device 50 includes an operation control portion 51 for controlling the circulation operation or the ink discharging operation, a temperature detection portion 52 for detecting the temperature of the ink, and a time measurement portion 53 that measures the elapsed time after an ink flowing operation is finished.

The operation control portion 51 controls an operation of the circulation pump 40 on the circulation flow path JF, an operation of the lifting mechanism 26*b* for lifting the cap 26*a*, an operation of the suction pump 27 on the discharge flow path HF or the like. For controlling, the operation control portion 51 refers to a control table 51*a* in which an operation start time, an operation time, and an operation speed for use in controlling the operation of the circulation pump 40 and the suction pump 27 are stored. The control device 50 stores this control table 51*a*.

The temperature detection portion 52 detects the temperature of at least part of the ink in the ink supply tube 31 by means of, for example, a non-contact type temperature sensor 52*a*. In this case, it is preferable that the temperature sensor 52*a* be disposed at a position where a detected temperature shows an average temperature of the whole ink in the ink supply tube 31.

The time measurement portion 53 has a timer circuit and measures the elapsed time after the operation of the circulation pump 40 and the suction pump 27 is finished. In addition, the time measurement portion 53 measures the operation time of the circulation pump 40 during the circulation operation and the operation time of the suction pump 27 during the discharge operation.

As described above, if pigment ink is used in the embodiment, pigment particles, as solutes, form sedimenting components which are likely to be sedimented in solvent. In this case, the sedimentation velocity varies corresponding to the ink viscosity (the viscosity of the solvent) which varies with a temperature change. Although this property can be explained by, for example, Stokes' law in which the viscosity coefficient of a medium (solvent) varies with a temperature change, a change in the viscosity of the ink will be described, by way of example, with reference to drawings.

Figure 3A:
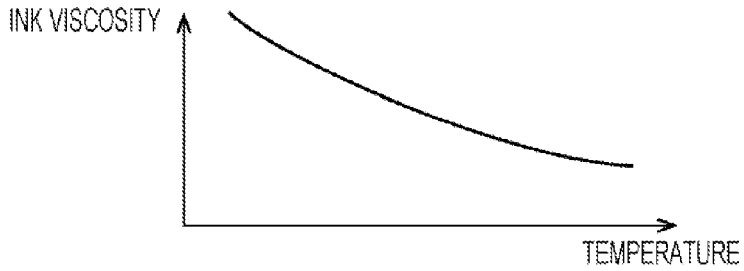
FIG. 3A is a graph showing a relationship between the temperature and the viscosity of ink.

As shown in FIG. 3A, a relationship between the viscosity and the temperature of ink can be expressed by Andrade's formula, for example. That is, the higher the temperature of ink is, the lower the viscosity of ink is. Also, the lower the temperature of ink is, the higher the viscosity of ink is. Furthermore, the change rate of the viscosity of ink varies greatly as the temperature of ink lowers.

Figure 3B:
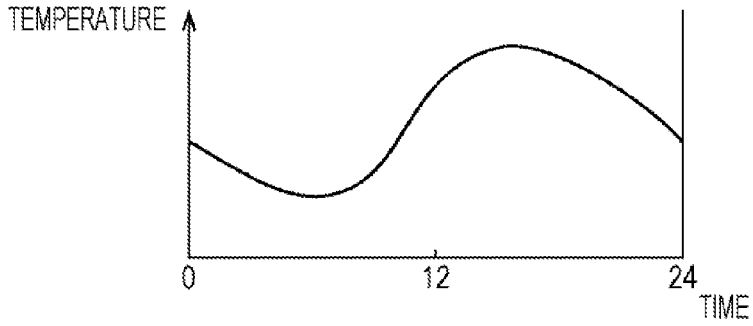
FIG. 3B is a graph showing a temperature change of ink in a day.

Meanwhile, in terms of, for example, a daily (24 hours) cycle, temperature (atmospheric temperature) decreases in the time range corresponding to the morning and evening, and increases in the time range corresponding to the daytime, as shown in FIG. 3B. Otherwise, although not shown, in terms of an annual (365 days) cycle, temperature (atmospheric temperature) decreases in the period corresponding to winter and increases in the period corresponding to summer.

Figure 3C:
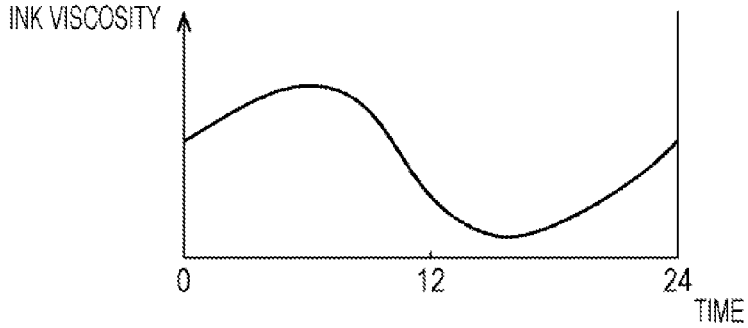
FIG. 3C is a graph showing a viscosity change of ink in a day.

Thus, if the use environment temperature of the printer 11 varies, as shown in FIG. 3C, with a temperature change in a day, for example, the viscosity of the ink also varies similarly. In other words, the viscosity of the ink increases in the time range corresponding to the morning and evening when temperature decreases, and decreases in the time range corresponding to the daytime when temperature increases.

Figure 3D:
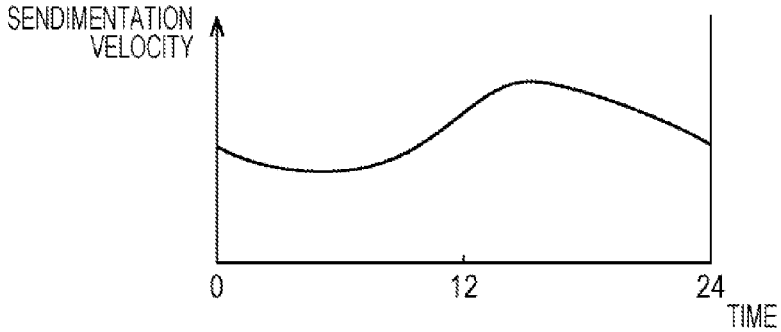
FIG. 3D is a graph showing a sedimentation velocity change of sedimenting components of ink in a day.

As a result, in terms of a daily (24 hours) cycle, the sedimentation velocity of the ink decreases in the time range corresponding to the morning and evening when temperature lowers, and increases in the time range corresponding to the daytime when temperature increases, as shown in FIG. 3D. The ink supply device EKS of the embodiment causes the ink in the ink supply tube 31 to flow in correspondence with this varying sedimentation velocity of the ink.

Next, an operation (a flowing operation) of the ink supply device EKS will be described with reference to FIGS. 4, 5A, 5B, 5C, 6A, and 6B.

The ink supply device EKS of the embodiment carries out a flow control process such that the ink flow condition varies with a temperature change of the ink. Further, the ink flow control process of the embodiment includes a first flow condition change process in which a method for flowing ink is changed and an interval of an ink flowing operation is not changed and a second flow condition change process in which the interval of the ink flowing operation is changed and the method for flowing ink is not changed.

The ink flow control process is started when a user of the printer 11 inputs a predetermined signal to the control device 50 using input means (not shown) provided on the printer 11, for example. Otherwise, the ink flow control process may automatically start when a detected temperature detected by the temperature detection portion 52 is within a temperature range suitable for use of the printer 11, that is, a temperature range within which ink can be stably ejected from the liquid ejecting head 21. The temperature range suitable for use of the printer 11 is between 20 degrees Celsius and 30 degrees Celsius, for example.

First Flow Condition Change Process

First, the first flow condition change process will be described.

Figure 4:
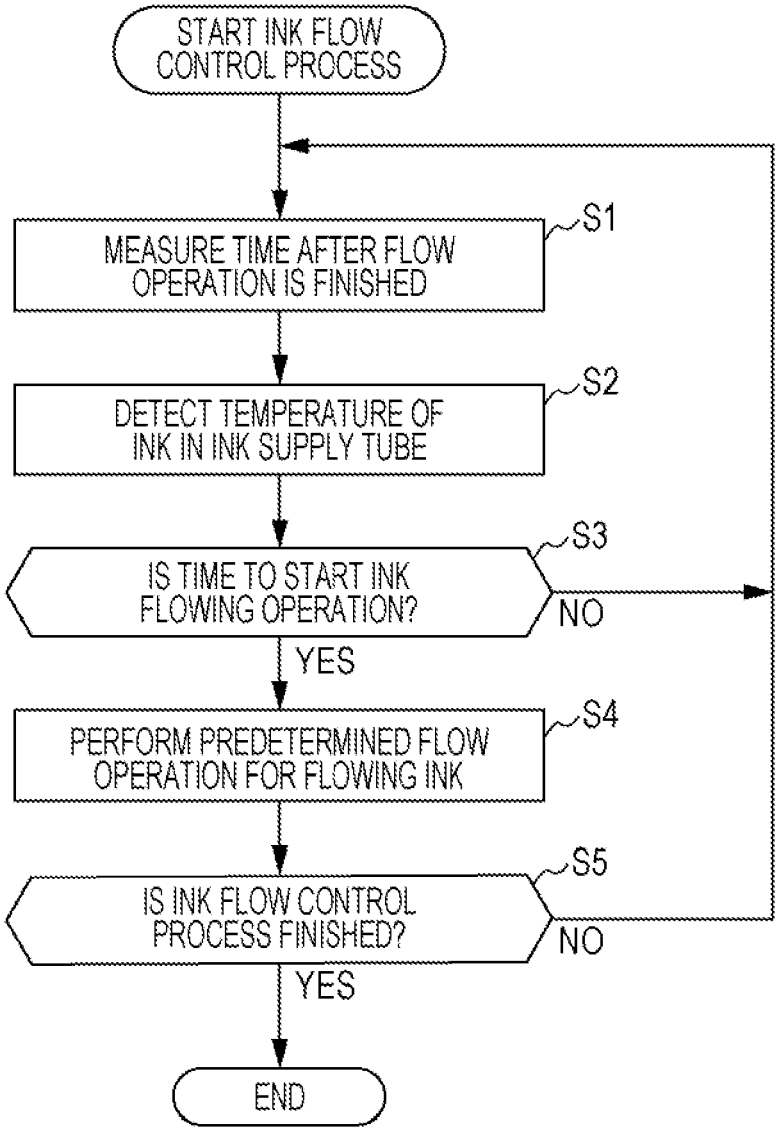
FIG. 4 is a flow chart showing an ink flow control process of an ink supply device of an embodiment.

When the ink flow control process starts in the ink supply device EKS, as shown in FIG. 4, a time measuring process for measuring the time after the flowing operation is finished is performed in step S1. In this step, the time measurement portion 53 measures, for example, the elapsed time from a finishing point of the rotation operation of the circulation pump 40, the rotation operation of the circulation pump 40 being controlled by the operation control portion 51. Furthermore, in the embodiment, the time measurement portion 53 measures the elapsed time from a finishing point of the rotation operation of the circulation pump 40, which is carried out before the ink flow control process starts. Needless to say, in a first round of step S1 after the ink flow control process starts, the time measurement portion 53 may measure the elapsed time from a starting point of the ink flow control process.

Subsequently, the temperature of the ink in the ink supply tube is detected in step S2. In this step, the temperature detection portion 52 detects, using the temperature sensor 52*a*, the temperature of at least part of the ink flowing through the ink supply tube 31.

Next, whether or not it is an ink flow starting time is determined in step S3. In this step, the operation control portion 51 determines, by referring to the control table 51*a*, whether or not the elapsed time measured by the time measurement portion 53 attains to a set time (six hours, for example) which is set in correspondence with a detected temperature.

Based on a determination result in step S3, if the elapsed time does not attain to the set time (step S3: NO), the processes from step S1 to step S3 are repeated again. In this case, the repetitive processes from step S1 to step S3 are performed at predetermined time intervals. Further, in this repetitive processes, step S2 may be performed or may be not repeated (skipped) not to be performed. Otherwise, step S2 may be performed again if a temperature change becomes equal to or greater than a predetermined threshold value, for example.

In the determination result in step S3, if the elapsed time attains to the set time (step S3: YES), the process proceeds to step S4. Therefore, an ink flowing process is performed based on a predetermined flowing operation. In this step, by referring to the control table 51*a*, the operation control portion 51 causes the ink in the ink supply tube 31 to be circulated or causes the ink in the ink supply tube 31 to be discharged, in correspondence with the detected temperature which is detected in step S2.

Figure 5A:
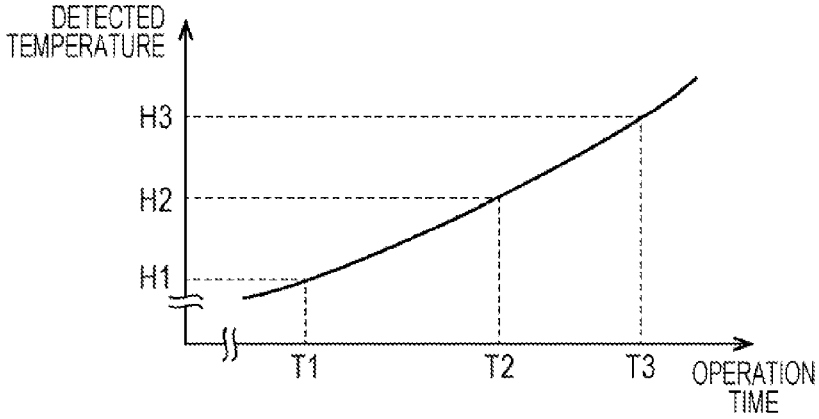
FIG. 5A is a graph showing a relationship between a detected temperature of ink and an operation time of a circulation pump.
Figure 5B:
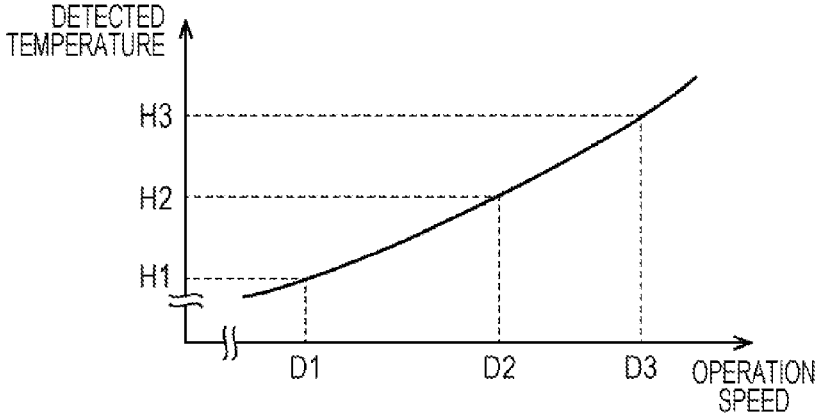
FIG. 5B is a graph showing a relationship between a detected temperature of ink and an operation speed of the circulation pump.
Figure 5C:
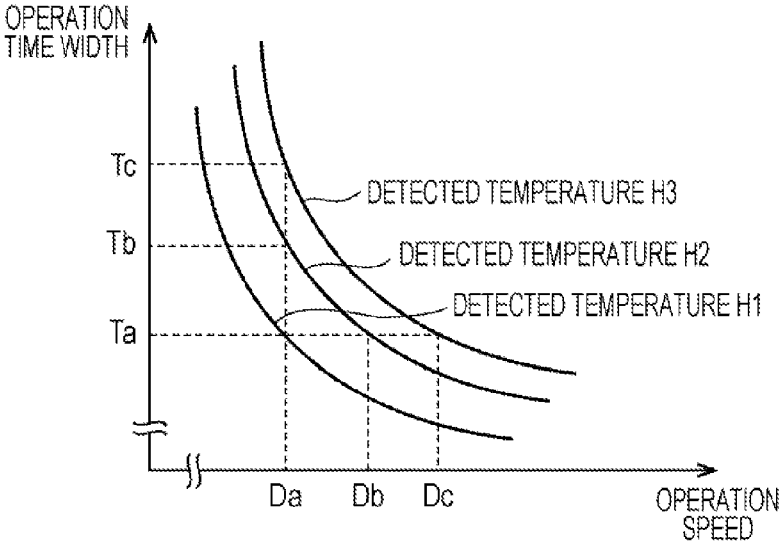
FIG. 5C is a graph showing a relationship between an operation time and an operation speed of the circulation pump, in which detected temperatures of ink are set to parameters and the same flow rate is established.

In other words, an ink flowing time, an ink flow velocity, or an ink flow rate in the circulation flow path JF, which is set corresponding to a detected temperature, as shown in FIGS. 5A, 5B, and 5C, is stored in the control table 51*a*. The operation control portion 51 causes the ink to flow, using a flowing method which uses the ink flowing time, the ink flow velocity, or the ink flow rate, which is stored in the control table 51*a* in correspondence with the detected temperature. In this manner, the operation control portion 51 changes the flow condition of the ink in the ink supply tube 31. Needless to say, it is preferable to change the flow condition, using the optimal flowing method chosen under the consideration of the sedimenting condition of the sedimenting components, which varies corresponding to a type of ink, or the shape or the length of the ink supply tube 31. Further, the ink flow velocity mentioned above means a mean flow velocity (ink flow rate/cross-sectional area of the ink supply tube at a predetermined position or cross-sectional area of the other supply flow paths).

When the ink flowing time is subject to change, for example, the rotation operating time of the circulation pump 40 is changed corresponding to the detected temperature, as shown in FIG. 5A. In other words, if the detected temperature is H1, an operation time is set to T1. In addition, if the detected temperature is H2 or H3, which is higher than the detected temperature H1, an operation time is set to T2 or T3, which is longer than the operation time T1.

Furthermore, when the ink flow velocity is subject to change, the operation speed (the rotational speed) of the circulation pump 40 is changed corresponding to the detected temperature, as shown in FIG. 5B. In other words, if the detected temperature is H1, an operation speed is set to D1. In addition, if the detected temperature is H2 or H3, which is higher than the detected temperature H1, an operation speed is set to D2 or D3, which is faster than the operation speed D1.

Furthermore, both the ink flowing time and the ink flow velocity may be subject to change. In a case where both the ink flowing time and the ink flow velocity are subject to change, the ink flowing time and the ink flow velocity may be changed such that the flow rate is maintained. In other words, the ink may flow through the ink supply tube 31 at a flow rate corresponding to the detected temperature.

In a following case, it is assumed that, in this ink flow, a detected temperature of the ink is H1 and an operation speed and an operation time of the circulation pump 40 is Da and Ta, as shown in FIG. 5C, for example. Additionally, when the subsequent ink flowing operation starts, if the detected temperature of the ink is H2 or H3, which is higher than the detected temperature H1, and if the operation time is maintained at Ta, the operation speed is set to Db or Dc, which is faster than an operation speed Da. Otherwise, if the operation speed is maintained at Da, the operation time is set to Tb or Tc, which is longer than the operation time Ta.

In this case, if the detected temperature is H2, a product (the flow rate) of the operation time Ta and the operation speed Db is the same as a product (the flow rate) of the operation time Tb and the operation speed Da, as shown in FIG. 5C. In addition, if the detected temperature is H3, the magnitude of a product (the flow rate) of the operation time Ta and the operation speed Dc is the same as the magnitude of a product (the flow rate) of the operation time Tc and the operation speed Da. In other words, combination values of the operation time and the operation speed, in which the flow rates are constant if detected temperatures are set to parameters, are stored in the control table 51*a*. Thus, the operation control portion 51 carries out changing the ink flow rate, which corresponds to the detected temperature, in the following manner. Considering the performance of the circulation pump 40, an installation state of the ink supply tube 31 or the like, the operation control portion 51 selects, by referring to the control table 51*a*, the optimal combination value of the operation time and the operation speed, among the combination values in which the flow rates are constant. Then, the operation control portion 51 changes the ink flow rate with reference to the optimal combination value.

Referring back to FIG. 4, whether or not the ink flow control process is finished is determined in subsequent step S5. In this step, if a user of the printer 11 inputs a termination signal of the ink flow control process or if the detected temperature detected by the temperature detection portion 52 is out of the temperature range suitable for use of printer 11, for example, less than 20 degrees Celsius or more than 30 degrees Celsius, the operation control portion 51 determines that the ink flow control process is finished. Based on this determination result, if it is determined that the ink flow control process is not finished (step S5: NO), the process returns to step S1, and thus the ink flow control process is continued. On the other hand, based on the determination result, if it is determined that the ink flow control process is finished (step S5: YES), the ink flow control process is finished.

In addition, in the ink flow control process shown in FIG. 4, step S2 may be performed between step S3 and step S4. In other words, the temperature of the ink in the ink supply tube 31 may be detected at the ink flow starting time or thereafter. Although not described in the above embodiment, it is needless to say that the ink flow control process shown in FIG. 4 can be also carried out in the discharge flow path HF.

According to the first flow condition change process of the embodiment, which is described above, it is possible to obtain the following advantages.

(1) It is possible to change the flow condition at the time of circulating the ink through the ink supply tube 31 or discharging the ink outside the ink supply tube 31, in correspondence with the sedimentation condition of the pigment particles, which varies with a temperature change, for example, in which a sedimentation velocity of the pigment particles (the sedimenting components) in the solvent is reduced if the temperature of ink lowers. Therefore, it is possible to suppress an unnecessary rotation operation of the circulation pump 40 or the suction pump 27, namely an unnecessary ink flowing operation of the circulation pump 40 or the suction pump 27.

(2) It is possible to change the ink flowing time in the ink supply tube 31, in correspondence with the sedimentation condition of the pigment particles, which varies with the temperature change of the ink, for example, in which the operation time of the circulation pump 40 or the suction pump 27 is shortened as the temperature of liquid lowers. Therefore, it is possible to suppress an unnecessary ink flowing operation of the circulation pump 40 or the suction pump 27.

(3) It is possible to change the ink flow velocity in the ink supply tube 31, in correspondence with the sedimentation condition of the pigment particles, which varies with a temperature change of the ink, for example, in which the ink flow velocity in the ink supply tube 31 decreases as the temperature of the ink lowers. Therefore, it is possible to suppress an unnecessary ink flowing operation of the circulation pump 40 or the suction pump 27.

(4) In the ink supply tube 31, when the sedimenting condition of the pigment particles varies in correspondence with the shape of the ink supply tube 31, for example, the ink flow rate is changed, by causing both the ink flowing time and the ink flow velocity to be changed in correspondence to the temperature change of the ink, to correspond to the sedimentation condition. In addition, for changing the ink flow rate, if the agitating effect can be expected by increasing the flow velocity, the flow velocity is more increased by shortening the flowing time. Otherwise, if the agitating effect can be expected by extending the flowing time, the flowing time is extended by decreasing the flow velocity. In this manner, it can be expected to suppress an unnecessary ink flowing operation of the circulation pump 40 or the suction pump 27 and to effectively flow the ink in correspondence with the sedimentation condition of the pigment particles.

(5) In a state where the ambient temperature range of the ink supply device EKS is set between 20° C. to 30° C., in which the ink can be stably ejected by the liquid ejecting head 21, the rotation operation of the circulation pump 40 or the suction pump 27 is controlled in correspondence with the detected temperature. Therefore, it is possible to effectively suppress an unnecessary ink flowing operation of the circulation pump 40 or the suction pump 27.

(6) In the ink supply tube 31, it is possible to adequately circulate the ink in correspondence with the sedimentation condition of the pigment particles or to discharge the ink outside the ink supply tube 31. Thus, it is possible to achieve the printer 11 that is capable of suppressing an unnecessary ink flowing operation.

Second Flow Condition Change Process

Subsequently, the second flow condition change process will be described. In this process, when the elapsed time measured by the time measurement portion 53 attains to the set time which is decided in correspondence with the detected temperature detected by the temperature detection portion 52, the operation control portion 51 causes the circulation pump 40 or the suction pump 27 to operate. In other words, the operation frequency (the number of times) of the circulation pump 40 or the suction pump 27 is changed by causing operation intervals of the circulation pump 40 or the suction pump 27 to be changed in correspondence with the detected temperature.

Figure 6A:
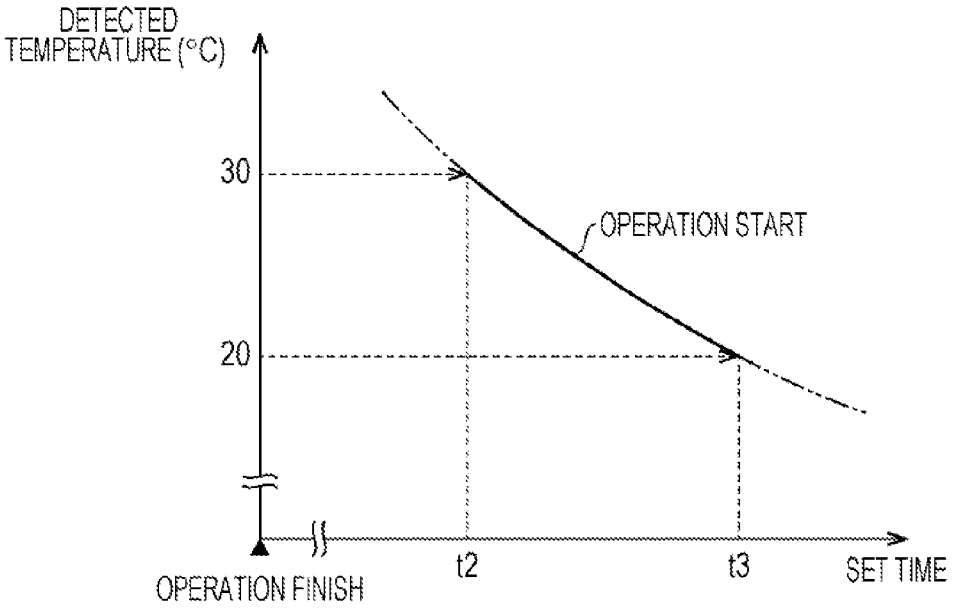
FIG. 6A is a graph showing a relationship between a detected temperature detected by a temperature detection portion and a set time to start an ink flowing operation.

The second flow condition change process will be described with reference to the FIGS. 4, 6A, and 6B. In the following description of the second flow condition change process, a case in which the temperature of the ink in the ink supply tube 31 varies without much change and is substantially constant and a case in which the temperature varies are explained separately. In addition, a description of a configuration which is the same as that in the first flow condition change process will not be repeated.

First, in the case where the temperature of the ink in the ink supply tube 31 is substantially constant, the temperature which is detected in a first round of step S2 shown in FIG. 4 is set as a detected temperature. As shown in FIG. 6A, a set time to start the flowing operation, which corresponds to the detected temperature, is stored in the control table 51*a*. In other words, if the detected temperature is 20° C., the time to start a next flowing operation after the flowing operation is finished is a set time t3, and if the detected temperature is 30° C., the time to start a next flowing operation after the flowing operation is finished is a set time t2 which is shorter than the set time t3. Thus, the operation control portion 51 causes the circulation pump 40 or the suction pump 27 to operate when the set time which is decided in correspondence with the detected temperature detected by the temperature detection portion 52 elapses.

In addition, in the case where the temperature of the ink in the ink supply tube 31 varies, the temperature of the ink in the ink supply tube 31 is detected in step S2 shown in FIG. 4, each time step S2 is repeated at the predetermined time intervals. Further, the average value of all the detected temperatures of the ink is set as a detected temperature. In addition, the predetermined time interval is set to a value in which several rounds of step S2 can be performed before the next flowing operation starts. Needless to say, the time interval is set to a value in which the number of processing times of step S2 increases such that the average value of the varying temperature is improved in accuracy.

Figure 6B:
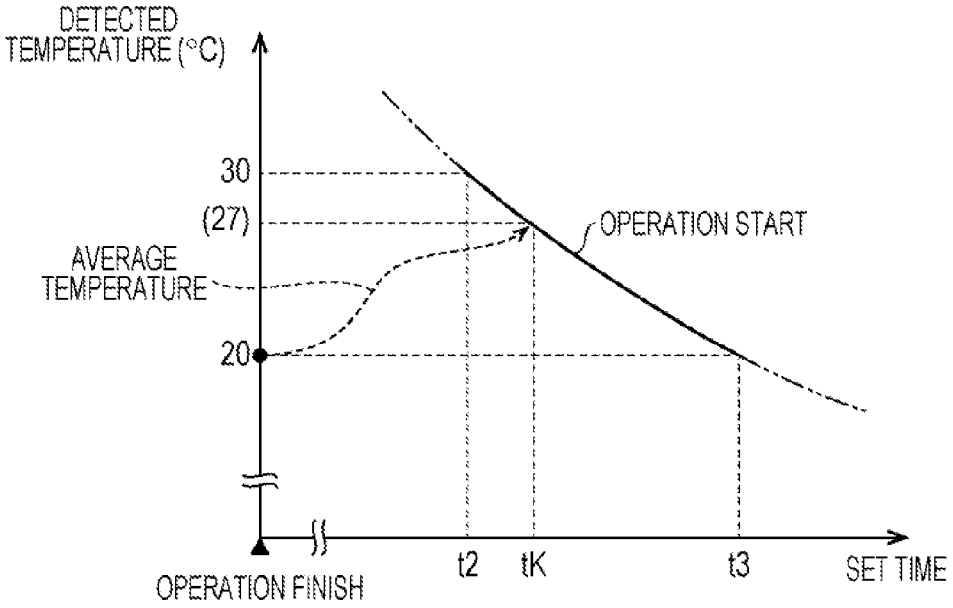
FIG. 6B is a graph showing a relationship between a detected temperature of ink, which varies, and a set time to start an ink flowing operation.

As a result, if the detected temperature (the average temperature) which is 20° C. at the ink flowing operation finish time varies (increases) in response to an increase in the temperature of the ink, as shown by the curve of thick broken line in FIG. 6B, the time to restart the flowing operation for flowing ink is shortened in response to an increase in the average temperature. Incidentally, in FIG. 6B, the average temperature of the ink of which the temperature is detected several times is about 27° C., and time tK is set as the time to start the flowing operation. In addition, after the preceding ink flowing operation is finished, the next ink flowing operation starts when set time tK which is shorter than set time t3 elapses in correspondence with an increase in the detected temperature of the ink. In other words, the frequency of the flowing operation increases.

According to the above-described second flow condition change process of the embodiment, it is possible to achieve the following advantages other than the advantages (1), (5), and (6) which are achieved in the first flow condition change process.

(7) It is possible to change the ink flow frequency in correspondence with the sedimentation condition of the pigment particles, which varies with a temperature change of the ink. For example, if the temperature of the ink is low in the ink supply tube 31, the operation interval of the circulation pump 40 or the suction pump 27 is extended by extending the set time. In this manner, it is possible to suppress an unnecessary ink flowing operation of the circulation pump 40 or the suction pump 27.

(8) If the temperature of the ink in the ink supply tube 31 varies owing to a seasonal temperature difference, a temperature difference between the morning and the daytime, or the like, for example, it is possible to adequately circulate the ink or discharge the ink outside the ink supply tube 31, in correspondence with the sedimentation condition of the pigment particles, which varies with the temperature change. Therefore, it is possible to suppress an unnecessary ink flowing operation of the circulation pump 40 or the suction pump 27.

Furthermore, the embodiment described above may be modified in other forms, such as the following embodiments.

In the embodiment described above, in a case of the second flow condition change process, if the temperature of the ink in the ink supply tube 31 is substantially constant, when the ink flow starting time is determined in step S3 shown in FIG. 4, the temperature detection portion 52 may set the temperature, which is detected in the preceding step S2, as the detected temperature.

In the embodiment described above, the operation control portion 51 may control the operation of the circulation pump 40 or the suction pump 27 even when the detected temperature detected by the temperature detection portion 52 is out of the temperature range of between 20 degrees Celsius and 30 degrees Celsius. For example, in a case where a working temperature range of the printer 11 is wide, it is preferable that the control range of the ink flowing operation be not limited in the range between 20 degrees Celsius and 30 degrees Celsius. It is preferable that the ink flowing operation be controlled in correspondence with the working temperature range (the range of between 5 degrees Celsius and 35 degrees Celsius, for example) of the printer 11.

In the embodiment described above, it is also allowable to adopt, as an ink flow control process, a combination of the first flow condition change process and the second flow condition change process. In other words, the time to start the operation of the circulation pump 40 or the suction pump 27 may be changed with the operation time or the operation speed thereof, in correspondence with the detected temperature of the ink, which is detected by the temperature detection portion 52. In this case, it is possible to more adequately cause flow of the ink in correspondence with the sedimentation condition of the sedimenting components in the ink supply tube 31.

In the embodiment described above, the circulation pump 40 or the suction pump 27 is not necessarily formed of a tube pump. The circulation pump 40 or the suction pump 27 may be formed of a diaphragm pump constituted to have a diaphragm and two check valves.

In the embodiment described above, the number of the ink cartridge 15 is not limited to four and may be less or more than four. Furthermore, in the printer 11, the movement direction of the liquid ejecting head 21 is not limited to the scanning direction, and the liquid ejecting head 21 may eject ink, at a fixed position, onto the paper sheet S.

In the embodiment described above, the printer 11 may be a liquid ejecting apparatus that ejects or discharges a liquid aside from ink. Furthermore, the small amount of liquid discharged from the liquid ejecting apparatus includes granule forms, teardrop forms, and forms that pull trails in a string-like form therebehind. In addition, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a liquid carrier are included as well. Ink, a liquid crystal or the like is exemplified as a representative example of a liquid in the embodiments described above. In this case, the ink includes a general water-based ink and oil-based ink, aside from various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, a printing equipment, a micro dispenser or the like. Further, the liquid ejecting apparatus may be a liquid ejecting apparatus for precisely ejecting lubricant to a precision machine such as a watch or a camera, or a liquid ejecting apparatus that ejects on a substrate a transparent resin liquid such as an ultraviolet curing resin in order to form a minute hemispherical lens (an optical lens) used in an optical communication element or the like. In addition, the liquid ejecting apparatus may be a liquid ejecting apparatus that ejects an etching liquid such as acid or alkali to etch a substrate or the like.

CROSS REFERENCES TO RELATED APPLICATIONS

The entire disclosure of Japanese Patent Application No. 2012-275397, filed Dec. 18, 2012 is expressly incorporated by reference herein.

What is claimed is:

1. A liquid supply device that supplies liquid to a liquid ejecting portion which ejects the liquid, comprising:

a liquid storage portion that stores the liquid containing sedimenting components which are sedimented in solvent;

a liquid supply path that extends from the liquid storage portion to the liquid ejecting portion and through which the liquid to be supplied to the liquid ejecting portion can flow;

a circulation flow path that has a first end and a second end, wherein the first end and the second end are connected to the liquid supply path;

a liquid flowing portion that is operated to cause the liquid to flow through at least part of the liquid supply path and the circulation flow path;

a temperature detection portion that can detect the temperature of at least part of the liquid in the liquid supply path; and an operation control portion that controls an operation of the liquid flowing portion in correspondence with a detected temperature of the liquid, which is detected by the temperature detection portion, such that a flow condition of the liquid in the liquid supply path changes.

2. The liquid supply device according to claim 1, wherein the operation control portion controls an operation time of the liquid flowing portion to be extended or shortened in correspondence with the detected temperature, which is detected by the temperature detection portion, thereby a flow condition of the liquid changes.

3. A liquid ejecting apparatus comprising:

a liquid ejecting portion that ejects liquid; and the liquid supply device according to claim 2.

4. The liquid supply device according to claim 1, wherein the operation control portion controls a liquid flow velocity in the liquid supply path to be increased or reduced in correspondence with the detected temperature, which is detected by the temperature detection portion, thereby a flow condition of the liquid changes.

5. A liquid ejecting apparatus comprising:

a liquid ejecting portion that ejects liquid; and the liquid supply device according to claim 4.

6. The liquid supply device according to claim 1, further comprising:

a time measurement portion that measures the elapsed time after an operation of the liquid flowing portion, wherein the operation control portion causes the liquid flowing portion to operate when the elapsed time measured by the time measurement portion attains to a predetermined set time, which is set in correspondence with the detected temperature detected by the temperature detection portion, thereby a flow condition of the liquid changes.

7. A liquid ejecting apparatus comprising:

a liquid ejecting portion that ejects liquid; and the liquid supply device according to claim 6.

8. The liquid supply device according to claim 1, wherein the temperature detection portion detects an average value of the temperatures of the liquid, which are detected at predetermined time intervals, as the detected temperature of the liquid.

9. A liquid ejecting apparatus comprising:

a liquid ejecting portion that ejects liquid; and the liquid supply device according to claim 8.

10. The liquid supply device according to claim 1:

wherein the operation control portion controls an operation of the liquid flowing portion when the detected temperature is within the range of between 20 degrees Celsius and 30 degrees Celsius.

11. A liquid ejecting apparatus comprising:

a liquid ejecting portion that ejects liquid; and the liquid supply device according to claim 10.

12. A liquid ejecting apparatus comprising:

a liquid ejecting portion that ejects liquid; and the liquid supply device according to claim 1.

13. The liquid supply device according to claim 1, wherein the temperature detection portion detects the temperature of at least part of the liquid between the first end and the second end.

14. A liquid ejecting apparatus comprising:

a liquid ejecting portion that ejects liquid; and the liquid supply device according to claim 13.

15. The liquid supply device according to claim 1, wherein the liquid flowing portion is provided in the circulation flow path.

16. A liquid ejecting apparatus comprising:

a liquid ejecting portion that ejects liquid; and the liquid supply device according to claim 15.

17. A liquid supply device that supplies liquid to a liquid ejecting portion which ejects the liquid, comprising:

a liquid storage portion that stores the liquid containing sedimenting components which are sedimented in solvent;

a liquid supply path that extends from the liquid storage portion to the liquid ejecting portion and through which the liquid to be supplied to the liquid ejecting portion can flow;

a liquid flowing portion that is operated to cause the liquid to flow through at least part of the liquid supply path;

a temperature detection portion that can detect the temperature of at least part of the liquid in the liquid supply path; and an operation control portion that controls an operation time of the liquid flow portion to be shortened as the temperature of the liquid is lowered.

18. A liquid ejecting apparatus comprising:

a liquid ejecting portion that ejects liquid; and the liquid supply device according to claim 17.

19. A liquid supply device that supplies liquid to a liquid ejecting portion which ejects the liquid, comprising:

a liquid storage portion that stores the liquid containing sedimenting components which are sedimented in solvent;

a liquid supply path that extends from the liquid storage portion to the liquid ejecting portion and through which the liquid to be supplied to the liquid ejecting portion can flow;

a liquid flowing portion that is operated to cause the liquid to flow through at least part of the liquid supply path;

a temperature detection portion that can detect the temperature of at least part of the liquid in the liquid supply path; and an operation control portion that controls a liquid flow velocity in the liquid supply path to be reduced as the temperature of the liquid is lowered.

20. A liquid ejecting apparatus comprising:

a liquid ejecting portion that ejects liquid; and the liquid supply device according to claim 19.

* * * * *